US008096280B2

(12) United States Patent
Ismailov

(10) Patent No.: US 8,096,280 B2
(45) Date of Patent: Jan. 17, 2012

(54) FUEL INJECTION SYSTEM AND FUEL INJECTOR WITH IMPROVED SPRAY GENERATION

(75) Inventor: Murad M. Ismailov, Holt, MI (US)

(73) Assignee: AADI Inc., Saginaw, MI (US)

( * ) Notice: Subject to any disclaimer, the term of this patent is extended or adjusted under 35 U.S.C. 154(b) by 206 days.

(21) Appl. No.: 11/883,628

(22) PCT Filed: Feb. 3, 2006

(86) PCT No.: PCT/US2006/003758
§ 371 (c)(1),
(2), (4) Date: Aug. 3, 2007

(87) PCT Pub. No.: WO2006/084084
PCT Pub. Date: Aug. 10, 2006

(65) Prior Publication Data

US 2008/0173731 A1 Jul. 24, 2008

Related U.S. Application Data

(60) Provisional application No. 60/650,390, filed on Feb. 4, 2005.

(51) Int. Cl.
*B05B 7/12* (2006.01)
*F23D 11/10* (2006.01)
*B02B 7/06* (2006.01)

(52) U.S. Cl. ..... 123/305; 123/304; 123/298; 239/423; 239/424; 239/425.5; 239/520; 239/524; 239/513; 239/416.5

(58) Field of Classification Search ..... 123/297, 123/298, 304, 472, 301, 305; 73/114.45; 239/533.2, 61, 406, 423, 424, 424.5, 435, 513, 515, 524, 520, 405, 416, 416.3, 416.4, 416.5
See application file for complete search history.

(56) References Cited

U.S. PATENT DOCUMENTS

| | | | | |
|---|---|---|---|---|
| 1,311,731 | A * | 7/1919 | Washburn | 239/430 |
| 2,674,984 | A * | 4/1954 | Bondi | 123/279 |
| 3,520,480 | A * | 7/1970 | Halvorsen | 239/404 |
| 4,338,898 | A * | 7/1982 | Bauder et al. | 123/279 |
| 4,552,310 | A | 11/1985 | Gaskell | |
| 4,705,535 | A * | 11/1987 | Lipp | 48/77 |
| 4,884,746 | A | 12/1989 | Lewis | |
| 5,127,156 | A | 7/1992 | Yokoyama et al. | |
| 5,518,182 | A | 5/1996 | Sasao | |
| 5,575,263 | A | 11/1996 | Pontoppidan et al. | |
| 5,577,666 | A | 11/1996 | Shen | |
| 5,655,715 | A | 8/1997 | Hans et al. | |

(Continued)

FOREIGN PATENT DOCUMENTS

DE 3423373 A1 * 3/1985

(Continued)

*Primary Examiner* — Stephen K Cronin
*Assistant Examiner* — Raza Najmuddin
(74) *Attorney, Agent, or Firm* — Richard C. Litman

(57) ABSTRACT

The present invention relates to a fuel injection system for a combustion engine. The system comprises a source of fuel, an injector and a means for delivering pressurized fuel strokes to said injector, said injector being arranged for generating at least two fuel jets with different jet parameters at closely adjacent locations and having directions such that the jets interact with each other along a surface interface therebetween so as to generate a fine spray. The jet breakup time is shortened and the droplet size is substantially reduced.

7 Claims, 3 Drawing Sheets

U.S. PATENT DOCUMENTS 5,666,920 A 9/1997 Ito et al.
5,771,866 A 6/1998 Staerzl
5,772,122 A 6/1998 Sugiura et al.
5,819,707 A 10/1998 Grytz et al.
5,826,804 A 10/1998 Reiter et al.
6,045,058 A * 4/2000 Dobbeling et al. ..... 239/11
6,095,437 A 8/2000 Nozawa et al.
6,113,012 A 9/2000 Wear et al.
6,189,803 B1 * 2/2001 Ganan-Calvo ..... 239/5
6,272,840 B1 8/2001 Crocker et al.
7,237,527 B2 * 7/2007 Pontoppidan ..... 123/298
2002/0000216 A1 * 1/2002 Ismailov ..... 123/305
2002/0000483 A1 1/2002 Shoji et al.
2003/0085308 A1 5/2003 Parrish
2003/0222159 A1 12/2003 Kobayashi et al.
2004/0020459 A1 2/2004 Arndt et al.
2004/0154584 A1 * 8/2004 Hayakawa et al. ..... 123/305

FOREIGN PATENT DOCUMENTS

JP 61-247865 11/1986
JP 06226149 A * 8/1994

* cited by examiner

FUEL INJECTION SYSTEM AND FUEL INJECTOR WITH IMPROVED SPRAY GENERATION

CROSS-REFERENCE TO RELATED APPLICATION

This application claims the benefit of PCT International Application Number PCT/US2006/084084, filed on Feb. 3, 2006, and also claims the benefit of U.S. Provisional Application Ser. No. 60/650,390, filed on Feb. 4, 2005, which are each herein incorporated by reference in their entirety.

The present invention generally relates to fuel injection systems and injector constructions for such systems.

BACKGROUND OF THE INVENTION

In the automotive industry, there are various means and ongoing researches for improving vehicle efficiency such as engine thermal efficiency, vehicle mass, friction and pumping penalties, aerodynamics, brake/tire and gearbox losses as well as idling, lubricating, turbo charging and other technological challenges.

However, the most effective approaches are still today related to the improvements of the injection, combustion and after-treatment processes. The improvement of thermal efficiency of the combustion process directly and proportionally impacts on fuel efficiency and exhaust emissions. The fact is that the internal combustion process in an engine cylinder is impacted by numerous superimposed phenomena as illustrated in FIG. 1. All of these phenomena are tridimensional, time-dependent, with involvement of transient multi-phase reactive flows to be passively or actively controlled over a wide range of the engine operation. The diesel heterogeneous spray and following after-diffusion combustion are mainly controlled by timing and shaping of fuel discharged rates within ultra-short time fractions, which are currently close to a few hundreds of microseconds.

It is therefore acknowledge that one critical and viable solution for improving engine efficiency is directly related to the increased performance of the fuel injection equipment (in additional to the implementation of variable valve train).

There are a number of known approaches to perform combustion at highest thermal efficiency with complete combustion, as depicted in FIG. 2. One may be quite familiar with each of these approaches based on practical experiences how they impact on engine performance and emissions. For instance, in diesel engine design, it is standard: (i) to center the outlet of a fuel injector In a bowl and to center the bowl in the piston; (ii) to trade-off fuel injection pressure vs. air motion to provide required mixing; (iii) to supply sufficient air to meet peak torque limits; (iv) to trade-off injection timing and compression ratio for best fuel economy; and (v) to optimize fuel economy within emission constraints.

However, the entire diesel combustion process is still very complex, rapid and transient. The air-fuel mixture is extremely heterogeneous can vary in a wide range in terms of air/fuel charge (typically from about 4 to 20).

As diesel combustion is largely controlled by air-fuel mixing dynamics, an improvement of such dynamics could largely improve the engine efficiency.

From a more practical standpoint, in an effort to generate a fine spray with a quick break-up time, the most recent efforts have consisted In drastically increasing the injection pressure. Thus the pressure levels currently applied in automotive diesel injection equipment are very high (typically 1350-2400 bar for diesel injection, 50-100 bars for gasoline direct injection systems and 3-20 bars for gasoline manifold injection systems.

In this regard, it has been found that the fuel jet dynamics is characterized by the ratio between the jet kinetic energy based on pressure energy transfer and the capillary energy accumulated due to surface tension over the nozzle hole. The development of spray is occurred shortly after fuel exited the nozzle and it can be controlled if the Weber number We, which is proportional to the square of the jet velocity, is greater than about 40.

Accordingly current diesel injection equipment, where We reaches $10^5$ to $10^6$ (corresponding to injection pressure of 1600-2000 bars), allows to produce a good fuel droplet size (Sauter mean diameter—SMD) of about 25-40 μm in diameter, within a short breakup time brt (typically one microsecond or so).

In other words, increasing the fuel pressure allows to decrease the jet breakup time and to downsize the spray droplets.

However, increasing the fuel pressure has several drawbacks. First of all, injectors working with such high supply pressure need to have extremely narrow discharge lumens, and an increased number of such lumens compared to prior injectors. The injector manufacture thus becomes expensive.

In addition, the injection system requires adaptations in the pumping and cooling devices to be used effectively onboard to account for such high pressures. Overall, the extra energy needed for generating such increased pressure is significant, reaching approximately a few hundred Watts.

There are also maintenance issues due to the increase of injection pressure, and in particular a fatigue of the injector tip material(s) and an increased fuel temperature in the return lines.

There have been tentative solutions to improve fuel injectors in order to improve fuel spray generation.

In particular, US patent application 2002/0000483 A1, by Shoji et al. discloses a fuel injector nozzle in which fuel flow from a common source exits at the nozzle through separate concentric openings. The openings are at slightly different angles, such that the jets collide soon after exiting the nozzle. This collision is supposed to break the fuel jets into smaller particles quickly and uniformly.

However, the collision occurs at a relatively large distance from the jet outlets (typically more than 20 mm) and produces relatively large fuel droplets in the spray (more than 30 microns). Such known injection system therefore fails to generate a very fine fuel spray as close as possible to the injector outlets.

U.S. Pat. No. 6,272,840 B1 issued to Crocker et al. shows a gas turbine fuel injector in which fuel is injected into the combustion chamber through concentric rings. The pilot fuel injection ring and main fuel injection ring mix with air injected into the chamber through additional concentric injection rings. This injection system mixes the fuel and air more quickly and reduces the NOx emissions from the engine.

However, such known injector needs additional pressurized air assistance for generating the fuel spray, which would need additional components in the global injection system. In addition, such injector Is adapted for the steady state conditions of a turbine, and would not be applicable to the non-steady mode of operation of an internal combustion engine.

Finally, U.S. Pat. No. 5,771,866, issued to Staerzl discloses a nozzle for a low pressure fuel injection system in which two fuel conduits are associated in a coaxial and concentric relation with each other. The conduits have a common termination and are disposed within the open end of a cap. As fuel is caused to flow through the first conduit, air at atmospheric pressure is drawn into the second conduit. As the liquid fuel and the air reach the common termination of the conduits within the cap, the liquid fuel is atomized into a fine spray or mist. By providing a fine mist even at low engine speeds, the fuel injector nozzle does not require an air compressor.

Such air-assisted fuel injectors were intensively studied in mid- and late 90's without promising any improvement in droplet size and breakup timing needed for internal combustion engines, especially for diesel type applications.

SUMMARY OF THE INVENTION

The present invention aims at improving fuel efficiency and exhaust emissions by a unique approach involving a high-quality fuel spray discharged and distributed into the combustion chamber, such spray approaching a ideal, homogeneous charged compression ignition engine (HCCI), while requiring lower injection pressure than in the prior art without requiring any pressurized air assistance or the like for generating the spray.

To this end, the present invention provides according to a first aspect a fuel injection system for a combustion engine, comprising a source of fuel, an injector and a means for delivering pressurized fuel strokes to said injector, said injector being arranged for generating at least two fuel jets with different jet parameters at closely adjacent locations and having directions- such that the jets interact with each other along a surface interface therebetween so as to generate a fine spray.

According to a second aspect, fuel injector for a combustion engine fuel injection system is provided, said injector being arranged for generating at least two fuel jets with different jet parameters at closely adjacent locations and having directions such that the jets interact with each other along a surface interface therebetween so as to generate a fine spray.

Preferred but non limiting aspects of the fuel injection system and fuel injection system of the invention are as follows:

- said jet parameter is the jet velocity.
- said jets have directions extend substantially parallel to each other.
- said jets are concentric.
- said injector is arranged for generating more than two fuel jets.
- said injector comprises a single injector outlet from which said jets are delivered.
- said outlet is cylindrical.
- said injector comprises a single fuel inlet.
- said injector comprises an inner cylindrical channel connected to an injector inlet, a first lumen essentially coaxial with said channel and a series of second lumens extending around said first lumen in an oblique direction, an outlet passage essentially coaxial with said channel and said first lumen, and a guiding chamber for guiding the fuel jets delivered by said second lumens along the wall of said outlet passage.
- said guiding chamber has an outer frustoconical wall.
- said outer frustoconical wall connects in a continuous manner to said outlet passage.
- said guiding chamber has an inner frustoconical wall of greater apex angle than said outer frustoconical wall, said second lumens opening in said inner frustoconical wall.

Thanks to the present invention, a fuel spray is generated wherein an ultra-short primary breakup time (typically a few tens of microseconds) Is obtained for quicker start of the fuel-air mixing, and the spray is made of micron-scaled droplet size for quicker completion of evaporation and start of ignition, this being advantageous for all kinds of gasoline and diesel injectors. A more complete combustion process can thus obtained.

In addition, the above results are obtained with a much lower fuel pressure compared to prior art injection systems.

BRIEF DESCRIPTION OF THE DRAWINGS

The present invention will be better understood from the following detailed description of a preferred embodiment thereof, given with reference to the appended drawings in which.

DETAILED DESCRIPTION OF A PREFERRED EMBODIMENT

The injection principle of the present invention is based on spray breakup phenomena related to the following physical properties of jet-sprays:

(i) a high velocity jet delivered by an injector nozzle gives rise to a propagation of waves stably formed on the jet surface with a well defined wavelength A downstream of the injector nozzle;

(ii) these surface waves are highly sensitive to any off-axis inclined force (excitation) by various kinds of physical actions such as shock waves, viscous friction, thermal or acoustic impacts; and (iii) the breakup time of the spray and the droplet size are strongly dependent from a ratio between a surface affected sub-layer thickness and the jet diameter.

According to the present invention, the breakup excitation is based on a direct interference between two substantially parallel liquid jets, designated here as core and periphery jets CJ and PJ respectively.

Figure 1:
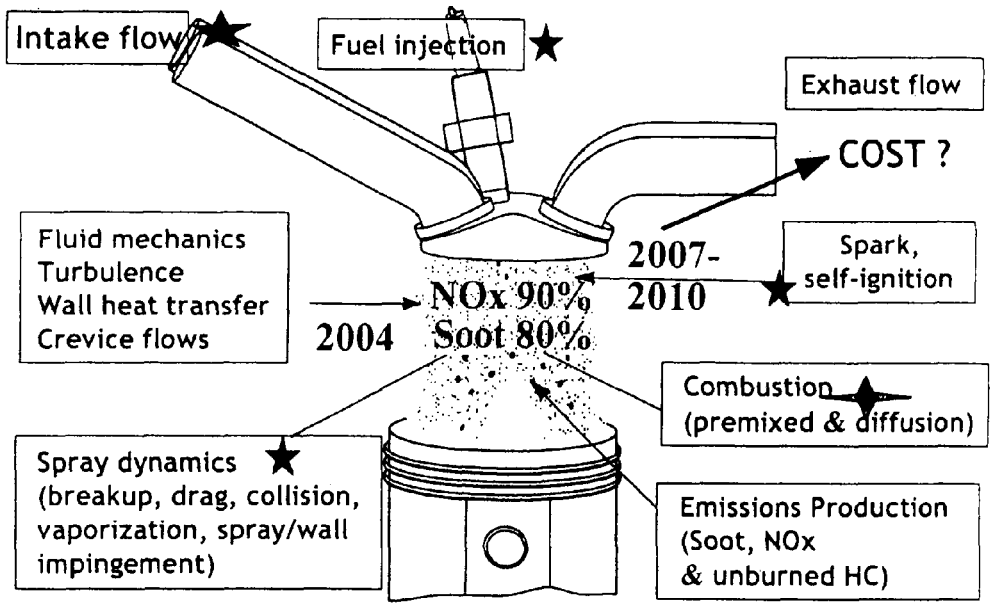
FIG. 1 illustrates the various concerns of fuel injection and combustion in modern piston-driven combustion engines.
Figure 2:
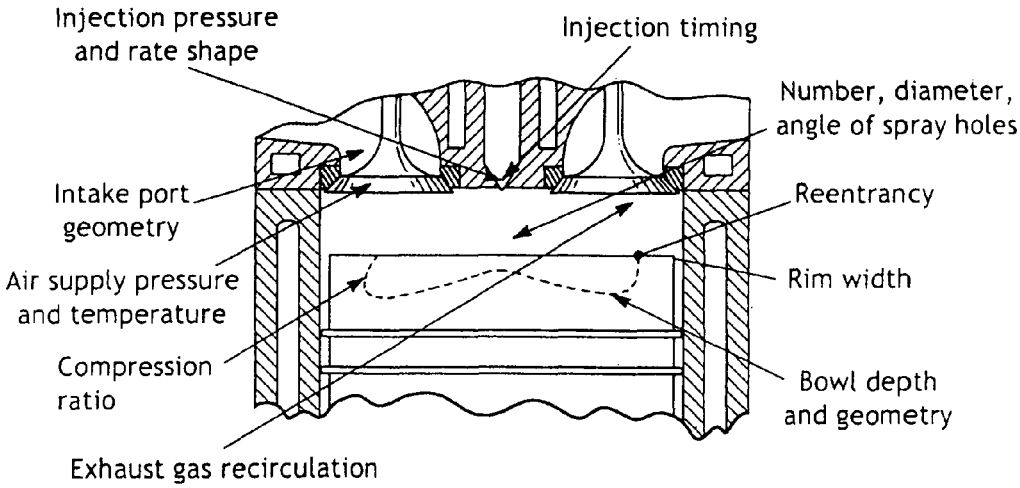
FIG. 2 illustrates a number of parameters that impact fuel injection and combustion.
Figure 3:
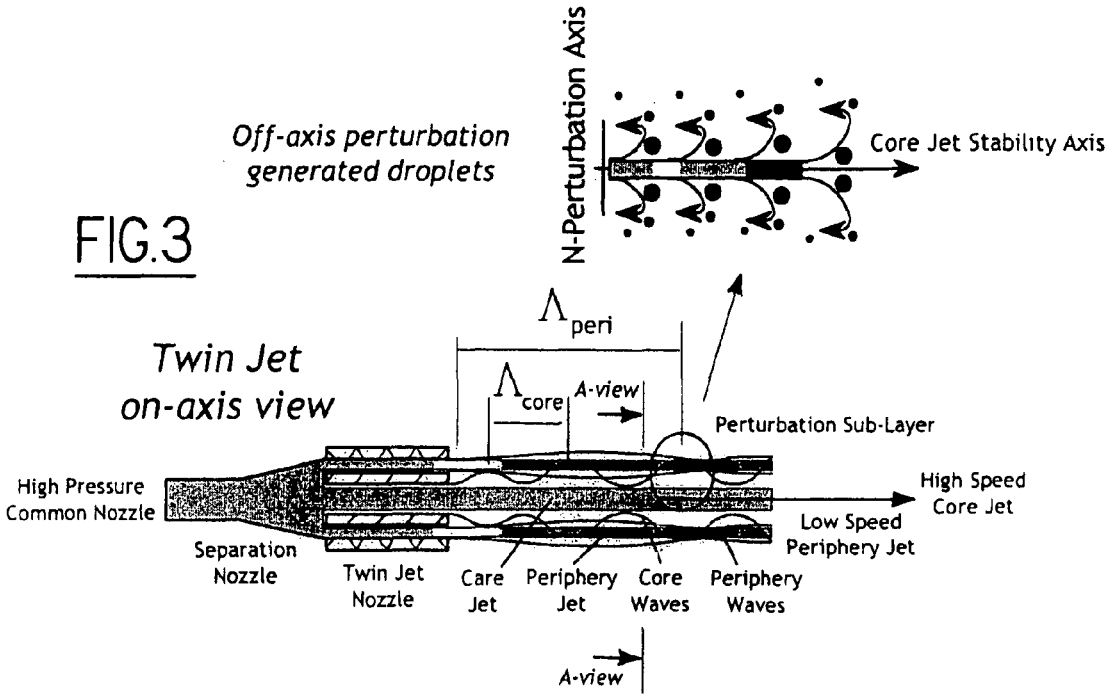
FIG. 3 is a schematic view illustrating the principle of fuel jet interaction according to the present invention.

This twin-jet breakup mechanism is schematically depicted in FIG. 3. The CJ and PJ jets have different parameters such as jet velocities and/or jet pressures and/or jet flow rates (most typically different velocities), and in other words, different surface wavelengths. Due to viscous friction, the PJ coaxial flow impacts on the CJ flow core jet as a strong surface perturbation (excitation force), so that the CJ flow brakes up quickly and controllably. The controllability of the breakup time and droplet size is linked with two Injection factors: (i) a ratio between the wavelengths of the CJ and PJ flows and (ii) a ratio between the PJ sub-layer thickness (a factor of induced impact energy) and the CJ diameter.

Figure 3A:
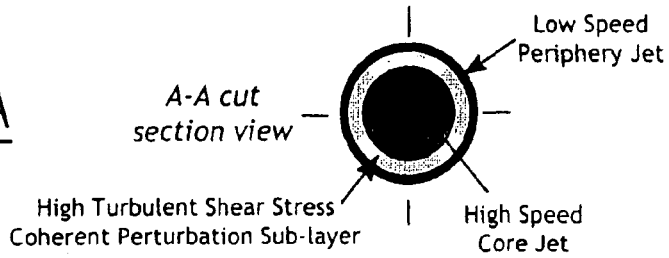
FIG. 3A is a cross-sectional view of the representation of FIG. 3.

Practically and as more clearly shown in FIG. 3A, a preferred form of a twin jet injector of this invention is capable of generating two concentric and generally cylindrical jets, the first jet or center jet being cylindrical and the second jet or peripheral jet being annular. In this diagrammatic illustration, both jets are generated through respective center and peripheral nozzles CN and PN, although it will be seen that the two jets can be generated from a single nozzle and that other jet arrangements are possible.

In the diagrammatic illustration of FIGS. 3 and 3A, the CJ jet comes out of a center nozzle under a high pressure with a first jet velocity. Due to an increased cross-sectional area of the peripheral nozzle, the pressure of the PJ flow is reduced, thus resulting in a lower periphery jet velocity.

The CJ and PJ jets thus interfere at their dynamic viscous boundaries where the surface waves of two jets have different wavelengths. This interference consists in a shear-stress impact which creates excitation of the CJ flow within interference dynamic sub-layer with the PJ flow due to kinetic energies of both jets simultaneously induced in this sub-layer. The strongest excitation spots along the CJ-PJ flows axis are located at the positions where the ratio between wavelengths of the core and periphery jets is an integer number (1, 2, . . . N). The maximum effect is associated with the lower values on this number because the highest kinetic energy is available for excitation of the CJ flow.

Preferably, and since a single source of pressurized fuel is required like in prior art conventional injectors, a single triggering element (such as a solenoid valve) is sufficient to actuate both jets. However, because of the manner in which the spray is generated, other parts of the injector and the high-pressure hydraulics can be also simplified. For instance, with regard to the pressure source requirements, much lower pressure is needed to generate a high quality spray.

Figure 4:
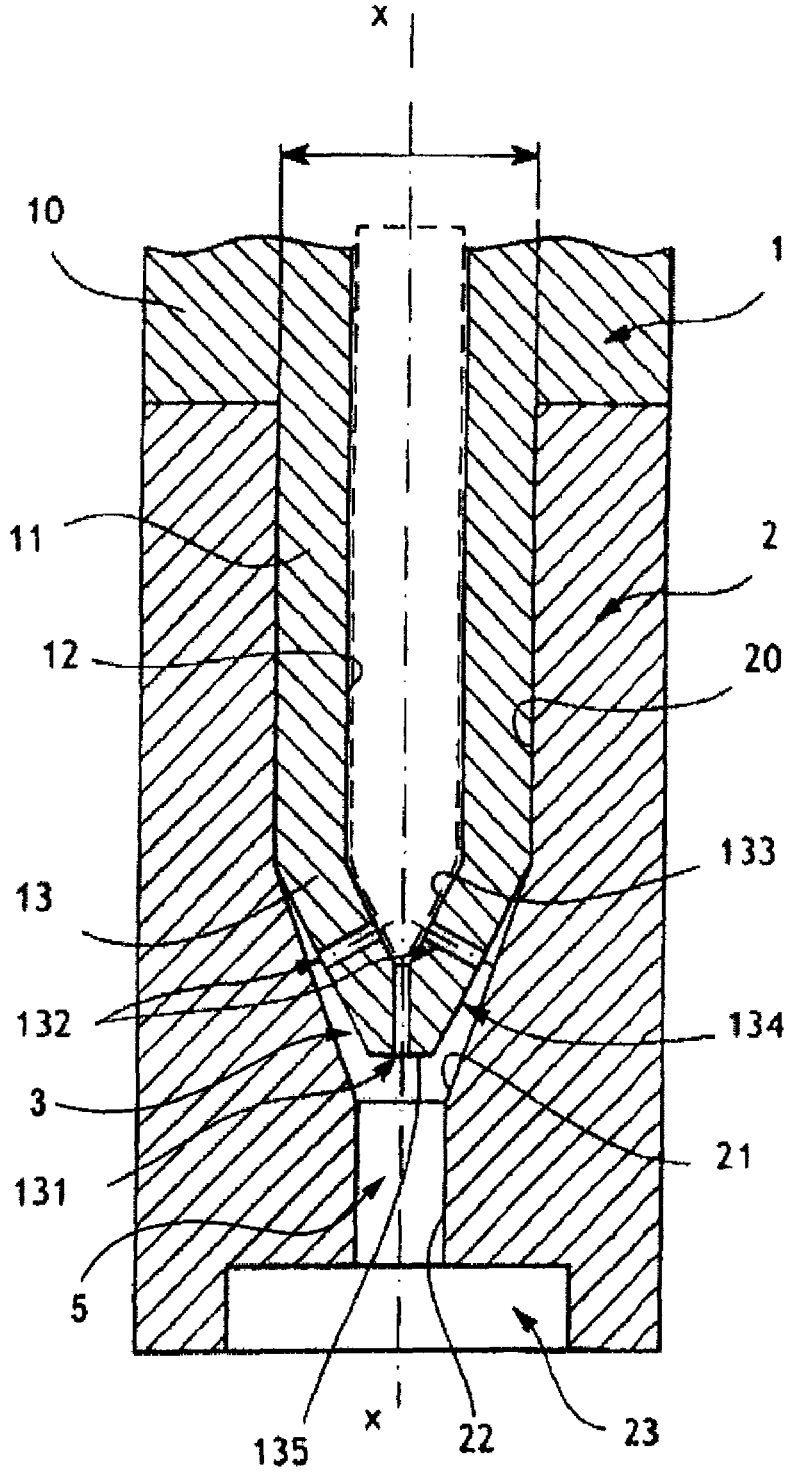
FIG. 4 is an axial sectional view of an injector according to a preferred embodiment of this invention.

A practical example of an injector construction according to the present invention is shown in FIG. 4.

It comprises a first root part 1 and a second end part 2.

The root part is designed so as to fit into a conventional diesel injector body, therefore ensuring full mechanical compatibility with existing engine designs. It includes a base 10 by which the injector can be fixed in position by any fixation means well known per se.

The root part further includes a tubular cylindrical portion 11 connected to the base portion and terminating into a frustoconical tip portion 13.

The cylindrical portion has an inner cylindrical passage 12 the dimensions of which are such that a conventional injector needle as the one used in a conventional diesel or gasoline direct injector can be used, as illustrated by the dashed-line contour.

In a manner known per se, this needle hydraulically drives the injection events and delivers the required amount of the discharge fuel (stroke) through a common fuel delivery channel located at the free end thereof.

The tip portion 13 of the root part 1 has an inner conical face 133 and an outer frustoconical face 134 have the same apex angle. In this tip portion is formed an axial lumen 131 though which the center fuel jet CP can be generated. This lumen preferably has the same axis x-x as the general injector axis and extends between the apex of the inner conical face and an outer flat face 135 which terminates said tip portion 13. In the conical wall of the tip portion are formed a plurality of oblique lumens 132 for generating the peripheral jet. Preferably these lumens 132 are regularly distributed around the conical wall of the tip. In a preferred embodiment, four oblique lumens are provided.

The injector second part 2 is in the shape of a generally cylindrical body with an inner cavity having, from top to bottom in FIG. 4, a cylindrical main portion 20, a frustoconical portion 21 with a decreasing diameter in the bottom direction, an injector outlet portion 22, defining outlet passage 5, and an outlet recess 23.

The axial length of the main portion 20 is substantially equal to the axial length of the cylindrical portion 11 of the first part.

The apex angle of portion 21 in smaller than the apex angle of the frustoconical face 134 of the first portion, so as to define therebetween a conical gap space 3 of complex shape of revolution, as illustrated, with communicates with the lumens 132 and at the same time with the injector outlet portion 22.

This space serves as a guide for leading the jets delivered by the lumens 132 into a peripheral jet. The core jet is generated by the axial lumen 131 and enters directly into the outlet portion 22, In a direction coaxial therewith.

With this construction, a core jet and a peripheral jet with differing jet velocities are generated, with short breakup time and droplet size reduction as mentioned above.

The first and second parts 1, 2 are preferably assembled together by a press-fit or thermo-fit technique. The parameters of the conical areas of the injector must be machined to match with appropriate accuracy the design parameters related to the differentiated flow rates and pressures for both jets as necessary for the Injector operation performance.

The various geometrical parameters of the above design are selected mainly as a function of the available fuel pressure, fuel stroke amount and desired velocities the core jet and the peripheral jet, and of the desired penetration length of the spray tip Inside of the combustion chamber.

Typical ranges for state of the art car diesel engine are as follows:

- first part outer cone angle: 30-50° relative to the injector axis x-x;
- second part inner cone angle: 5-15° smaller than the first part outer cone angle;
- cone axial length: from 2 to 12 mm for the first part cone, and from 2.5 to 15 mm for the second part cone;
- lumen diameters: from 220 to 380 microns for the core jet, and from 600 to 1500 microns for the periphery jets;
- number of oblique lumens: from 2 to 6;
- angle of oblique lumens: from perpendicular to +/−20° relative to the conical surface;
- outlet diameter: from 4 to 12 mm
- ratio between volumetric or mass flow rates of core and periphery jets: from 0.1 to 0.4
- ratio between jet length and jet external diameter L/d: from 3.5 to 6.5 for the core jet, and from 2.0 to 5.0 for the peripheral jet.

By jet length, it is meant the free length of the jets from outlet exit to the breakup point.

Of course these ranges are not to be construed as limiting, and values well before these ranges can be used for smaller or bigger injectors.

In addition, the skilled person will be able to devise many variants of the above injector structure.

First of all, although a two-jet system has been described in the foregoing, a system with three jets or more, at least two of which are substantially parallel to each other and have different jet parameters such as different jet velocities, is part of the invention.

In addition, the cross sectional shapes of the jets can be different from the ones described. More particularly, any jets at different velocities in contact with each other along a significant surface area, such as plane jets, curved jets with similar radiuses of curvature, etc. are also part of the invention.

The invention is particularly appropriate for a conventional fuel injection system where only one fuel liquid is available board.

The advantages of the present Invention can be summarized as follows:

- a fine spray with a droplet size in a micron range is rapidly generated (typically in sub-millisecond time fraction);

the injector design and assembling tools can be very simple and inexpensive, and appropriate for mass production;

much lower injection pressure levels are required (typically only from 10 to 50 bars above the peak piston-induced pressure that may exist inside the cylinder at the time of the fuel stroke) compared to currently employed fuel injection equipment requiring pressures over 2000 bars; this significantly decreases the cost of hardware (pump, materials, assembly units, etc.) and the energy penalties to generate fine fuel spray.

Although the most valuable application of the twin jet injector of the present invention is related to the fuel injection systems applied to internal combustion engines, it can also be applied with interest to other combustion processes such as in rockets, jet propulsion, etc., where thermal efficiency, exhaust and noise emissions are directly controlled by injection profile.

The invention claimed is:

1. A fuel injection system for a combustion engine, comprising a source of fuel, an injector and a means for delivering pressurized fuel strokes to said injector, said injector being arranged for generating at least two fuel jets with different jet parameters at closely adjacent locations and having directions such that the jets interact with each other along a surface interface therebetween so as to generate a fine spray, wherein said injector comprises:

an inner portion defining an inner cylindrical channel in fluid communication with an injector inlet, a first lumen being formed through a lower end of the inner portion of said injector, the first lumen being oriented co-axially with the inner cylindrical channel; and an outer portion, wherein a plurality of second lumens are formed through the lower end of the inner portion of said injector, with each said second lumen being angled downwardly from the inner cylindrical channel toward a guiding chamber formed between the lower end of the inner portion of said injector and a lower end of the outer portion of said injector, the lower end of said outer portion having an outlet passage formed therethrough, the outlet passage being oriented co-axially with the first lumen and the inner cylindrical channel, the guiding chamber being defined between an outer frustoconical wall and the lower end of the inner portion, the lower end having a frustoconical contour, an outer wall of the lower end having an angle formed with respect to a vertical axis of said injector being greater than an angle formed between the vertical axis and the outer frustroconical wall such that the guiding chamber increases in annular width about the lower end of the inner portion along the downward direction, each said second lumen extending between, and being in fluid communication with, the guiding chamber and the inner cylindrical channel, whereby the guiding chamber is adapted for guiding the fuel jets delivered by the plurality of second lumens along a wall of the outlet passage.

2. A fuel injection system according to claim 1, wherein said jet parameter is the jet velocity.

3. A fuel injection system according to claim 1, wherein said jets have directions extend substantially parallel to each other.

4. A fuel injection system according to claim 1, wherein said jets are concentric.

5. A fuel injection system according to claim 1, wherein said injector comprises a single injector outlet from which said jets are delivered.

6. A fuel injection system according to claim 5, wherein said outlet is cylindrical.

7. A fuel injection system according to claim 5, wherein said injector comprises a single fuel inlet.

* * * * *